US005322269A

United States Patent [19]

Fukube et al.

[11] Patent Number: 5,322,269

[45] Date of Patent: Jun. 21, 1994

[54] APPARATUS FOR FEEDING SHEETS SEPARATELY USING AN ELECTROSTATIC SEPARATOR AND SEPARATING MEMBER

[75] Inventors: Noriaki Fukube, Soka; Katsumi Kurihara, Tokyo; Hiroshi Tanabe, Yokohama; Hiroyuki Inobe; Hiroshi Fujiwara, both of Tokyo, Japan

[73] Assignee: Ricoh Company, Ltd., Tokyo, Japan

[21] Appl. No.: 889,634

[22] Filed: May 28, 1992

[30] Foreign Application Priority Data

May 29, 1991 [JP] Japan ..... 3-126003

[51] Int. Cl.[5] ..... B65H 3/16

[52] U.S. Cl. ..... 271/18.1; 271/34; 271/272

[58] Field of Search ..... 271/18.1, 18.2, 34, 271/121, 122, 147, 152, 153, 272

[56] References Cited

U.S. PATENT DOCUMENTS 3,198,514 8/1965 Barbera et al. .
4,327,904 5/1982 Holmes ..... 271/121 X
5,018,939 5/1991 Kishi et al. ..... 271/18.1 X

FOREIGN PATENT DOCUMENTS 157649 9/1983 Japan ..... 271/34
137733 7/1985 Japan ..... 271/18.1
198928 8/1990 Japan ..... 271/121
211129 9/1991 Japan ..... 271/147

*Primary Examiner*—D. Glenn Dayoan
*Assistant Examiner*—Boris Milef
*Attorney, Agent, or Firm*—Oblon, Spivak, McClelland, Maier & Neustadt

[57] ABSTRACT

The present invention relates to an apparatus for feeding sheets separately, the apparatus comprises a feed unit disposed over a stack of sheets for causing a conveyance force upon the uppermost of the stack thereby to feed the uppermost sheet from the stack with the conveyance force being directed in a sheet path direction. The feed unit has an alternating charged pattern on a surface thereof. The apparatus further comprises a separation unit disposed opposite to the feed unit so as to form a sheet path in association with the feed unit for causing a preventive force onto an under face of the fed sheet thereby to prevent the sheet from being fed. The preventive force is set to be less than the conveyance force and greater than a friction force between sheets. The separation unit has another alternating charged pattern on a surface thereof.

12 Claims, 10 Drawing Sheets

APPARATUS FOR FEEDING SHEETS SEPARATELY USING AN ELECTROSTATIC SEPARATOR AND SEPARATING MEMBER

BACKGROUND OF THE INVENTION

1. Field of the Invention

The present invention relates to an apparatus for feeding sheets, separately in an image-forming device.

2. Description of the Related Art

A friction type pick-up member is adopted in the form of a roller or a belt made of a material having a high friction coefficient, such as a rubber, for a feed unit for feeding a sheet in an image-forming device such as an electronic photo copy machine, or a printer. The friction type pick-up member has a simple structure, but it needs to be pressed onto a sheet by a spring, etc., to obtain a large friction force. Furthermore, the friction type pick-up member cannot necessarily feed a sheet steadily as the friction coefficient of the material of the pick-up member initially having a high friction coefficient, such as a rubber, may change over a long period of time or in certain environments.

Instead of the friction type pick-up member, a suction type pick-up member which sucks in air over a sheet to pick up and convey the sheet by negative pressure, is also used. A sheet can be fed more steadily by the suction type pick-up member than by the friction type. However, a loud noise is generated when air is sucked in, and size of the apparatus is large so that the suction type feed system is unsuitable for use in an office and so on.

Furthermore, it often occurs that two or more sheets are fed at once in the friction type feed system so that a unit for separating the sheets individually must be provided to feed the sheets separately.

A friction pad made from a material having a high friction coefficient, such as a rubber, or a rolling member rotating in a direction so as to return a sheet to be fed, is pressed onto the pick-up member or a conveyance roller provided at the lower reaches of the sheet path, and a friction coefficient between the friction pad or the rolling member and a sheet is set to be smaller than a friction coefficient between the pick-up member or the conveyance roller and a sheet, and larger than a friction coefficient between sheets in order to feed sheets separately. This enables only one sheet on the side of the pick-up member or the conveyance roller to be fed when multiple sheets are supplied together, and enables a sheet to be fed against a friction force between the friction pad or the rolling member and the sheet, when only one sheet is sent by the pick-up member. Since this friction type separating system is simple, it has been widely adopted.

However, this system does not necessarily enable sheets to be separated when a vacuum state exists between sheets of a stack of sheets in a cassette for feeding, when sheets pull against or adhere to each other due to an electrostatic force, or when each sheet has a long nap on the surface thereof so that the nap of one sheet becomes entangled with that on the facing sheet.

Instead of the friction type separating system, a system for separating sheets individually having a conveyance roller that rotates in such a direction as to feed a sheet and a prevention roller rotatable in either direction, arranged so as to provide a predetermined torque in such a direction as to return a sheet facing another sheet so that a sheet path is formed between them, and positioned at the lower reaches of the sheet path is disclosed in Japanese Patent Application Laying Open (KOKAI) No. 56-7847, laid open on Jan. 27, 1981 (The corresponding U.S. Pat. No. 2459773). In this system, the prevention roller does not slide over the conveyance roller or a sheet when the prevention roller makes contact with the conveyance directly or when only one sheet is fed by the pick-up roller into a clearance between the conveyance roller and the prevention roller, so that abrasion of the roller, reduction of a friction coefficient, generation of fiber dust from a sheet, and reduction of a friction coefficient owing to the dust can be prevented. Sheets cannot be separated steadily when a sheet tightly contacts a facing sheet or the nap of a sheet becomes entangled with that of the facing sheet as mentioned above, as the difference in friction forces between a roller and a sheet and between sheets is utilized in this system also.

The present applicants et al. disclosed an apparatus for feeding sheets steadily one by one without a separating unit in an image-forming device, and also an apparatus for feeding sheets separately and steadily when multiple sheets are fed together by a pick-up member owing to a tight contact of the sheets, aimed at overcoming the above-mentioned drawback of the related art in Japanese Patent application No. 2-283707 filed Oct. 22, 1990 (The corresponding U.S. patent application Ser. No. 07/774349)

The first of the above-mentioned apparatus is shown in FIG. 12. The apparatus comprises an endless belt 2 for feeding a sheet. The belt 2 is made of a dielectric material, wound round rollers 5 and 6 and positioned over a stack 1 of sheets, the apparatus comprises an electrode member 3 for applying an alternating voltage from a power source 4 for an alternating current. The electrode member 3 is arranged to contact a surface of the endless belt 2, to thereby generate an alternating charged pattern on the surface of the endless belt 2. The stack 1 of sheets is carried on a movable plate 7 to be moved upward by a member 8 which press up against the plate 7, and a top surface of the stack 1 is held at a predetermined position. A sheet is fed along guide plates 10 and is conveyed by a pair of rollers 9.

An unequal electric field is caused near the surface of the endless belt 2 when an alternating charged pattern is generated on the surface of the endless belt 2 as mentioned above. A Maxwell's stress effect acts on a sheet 1*a* in the form of a dielectric contacting the endless-belt when a non-uniform electric field is caused near the surface of the endless belt, so that the sheet 1*a* is adhered onto the endless belt 2 by an electrostatic force. Accordingly, the sheet 1*a* is conveyed along a sheet path as a result of movement of the endless belt 2 around rollers 5 and 6. The attractive force owing to the charged pattern acts only upon the uppermost sheet 1*a* of the stack 1 and not upon the second sheet 1*b* so that feeding of multiple sheets can be prevented when a contacting pressure between the belt 2 and the top surface of the stack 1 is adjusted to be small.

The second of the above-mentioned apparatus is shown in FIG. 13 and 14. The apparatus comprises a friction type separating unit facing the endless belt 2 forming a sheet path between them, in which the unit is shown as a friction pad 110 of a rubber fixed on a base member 111 and always urged in an upward direction by a spring 112.

Sheets can be steadily separated by this unit as a sheet is strongly adhered by an electrostatic attractive force stronger than a friction force between sheets. However, the reliability of a separation of sheets is reduced when a friction force between the pad 110 and a sheet becomes nearly equal to a friction force between sheets due to a reduction in a friction coefficient between the pad 110 and a sheet over a period of time or owing to an adhesion of fiber du'st from a sheet and so on, as the prevention of feeding the lowest sheet of sheets that are being fed together, depends on a friction force.

SUMMARY OF THE INVENTION

It is therefore an object of the present invention to provide an apparatus for feeding sheets separately, which has reliable performance in the separation of sheets even with the passage of time and in a changing environment.

The object of the invention can be achieved by an apparatus for feeding sheets separately comprising a feeding means disposed over a stack of sheets for causing a conveyance force upon the uppermost sheet of the stack thereby to feed the uppermost sheet from the stack, the conveyance force being directed in a sheet path direction and the feeding means having an alternating charged pattern on a surface thereof; and a separating means disposed opposite to the feeding means so as to form a sheet path in association with the feeding means for causing a preventive force onto an under face of the fed sheet thereby to prevent the sheet from being fed, the preventive force being set to be less than the conveyance force and greater than a friction force between sheets, the separating means having another alternating charged pattern on a surface thereof.

The uppermost sheet of the stack of sheets is attracted to be adhered to the feeding means by an electrostatic attractive force owing to a Maxwell's stress effect caused by an alternating charged pattern generated on the surface of the feeding means and fed along a sheet path, due to the above-mentioned structure of the present apparatus for feeding sheets separately.

The lowest sheet of sheets being fed together is attracted to and adhered onto the separating means by an electrostatic attractive force owing to an alternating charged pattern generated on the separating means facing the feeding means when the sheets are fed together because of an electrostatic attraction of the sheets owing to conditions of the environment, or entangling of the naps of the sheets. The sheets can be reliably separated individually so that sheets can be fed one by one since the attractive force of the feeding means for the uppermost sheet and the attractive force of the separating means to attract the lowest sheet can be set to be greater than the friction force between sheets, and the former force an be set-to be greater than the latter force. Sheets are attracted to and adhered onto the separating means to be prevented from traveling, in order from the bottom of the sheets when more than three sheets are fed at once.

An advantage of the present invention is that abrasion of the feeding means or the separating means is not caused even with the passage of time, and the separation performance for separating sheets is not reduced by a fiber dust from the sheets as the feeding means and the separating means do not employ a frictional mechanism.

Further objects and advantages of the present invention will be apparent from the following description of the preferred embodiments of the invention as illustrated in the accompanying drawings.

DESCRIPTION OF THE PREFERRED EMBODIMENTS

A sheet as described in the following is not restricted to a paper sheet but must be made of a dielectric material in the present invention.

Figure 1:
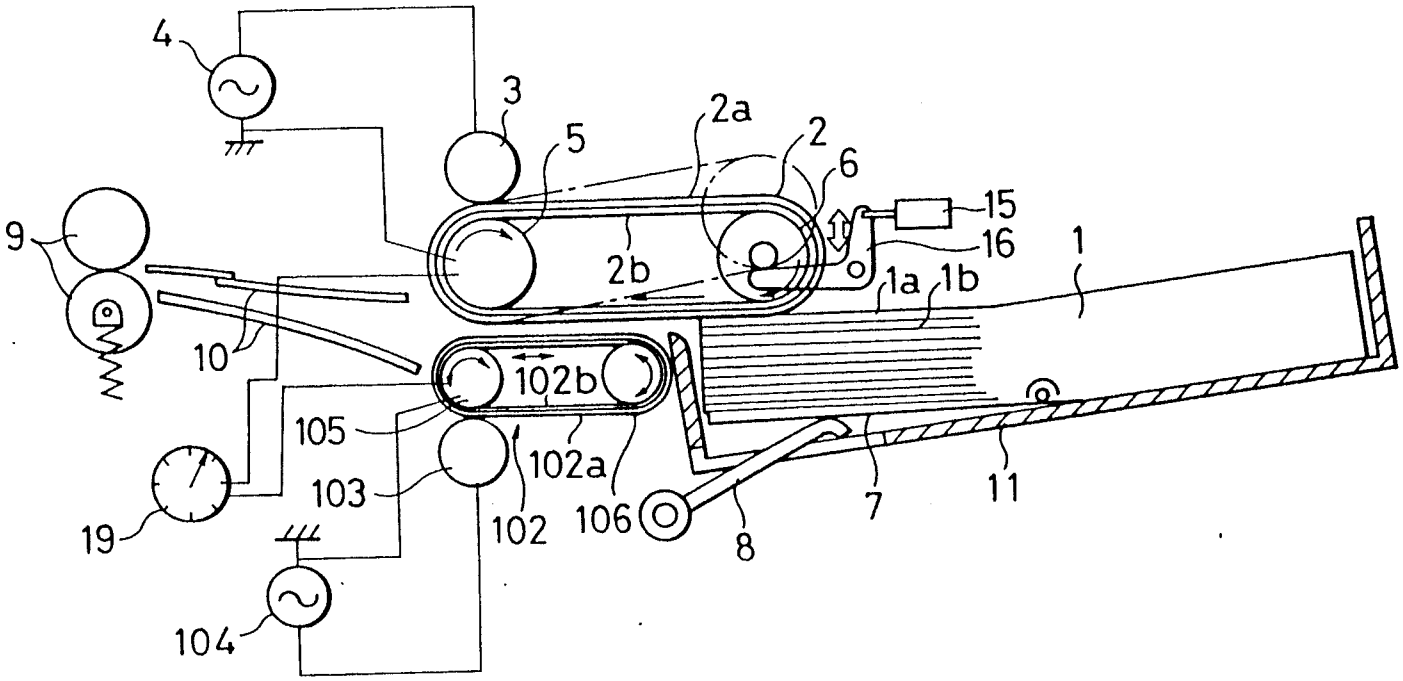
FIG. 1 is a sectional view of the first embodiment of an apparatus for feeding sheets separately according to the present invention.

The first embodiment according to the present invention is shown in FIG. 1. A belt 2 for feeding a sheet is formed as an endless belt wound around a drive roller 5 and a follower roller 6, and having two layers, an outer layer 2*a* made of a dielectric material such as a polyethylene terephthalate and having a thickness of about 50 μm and a resistance of not less than $10^8$ Ωcm, an inner layer 2*b* made of a conductor formed of evaporated aluminum and whose resistance is not greater than $10^6$ Ωcm. The drive roller 5 has a conductive rubber round a surface thereof having a resistance of not greater than $10^6$ Ωcm, and is grounded. The belt g can be moved around a pivot point of the drive roller 5 so that the belt 2 can contact or move away from a stack 1 of sheets laid on a movable plate 7 in a cassette 11 whose top sheet is positioned at a predetermined height. The belt 2 is moved pivotally around the drive roller 5 by a crank member 16 driven by a solenoid 15.

A separating belt 102 is provided at the lower reaches of a sheet path starting from a cassette 11 and at a location racine forward the feed belt 2 maintaining a small distance between the belts 102 and 2.

Therefore, abrasion of each belt is not caused, a load on a paper sheet is small, and electric fields of the feed belt 2 and of the separating belt 102 do not interfere with each-other. Furthermore, the belts 2 and 102 are free from each other when a paper sheet is not fed so that a load on a drive is reduced.

The separation belt 102 is an endless belt wound around a drive roller. 105 and a follower roller 106, similar to the feed belt 2, and has two layers. One is an outer layer 102*a* of a dielectric material, and the other is an inner layer 102*b* of a conductor. The resistance of the former is not less than $10^8$ Ωcm, and the resistance of the latter is not greater than $10^6$ Ωcm. The drive roller 105 has a conductive rubber around a surface thereof and a resistance of not greater than $10^6$ Ωcm. and is grounded. The separation belt 102 can move around the drive roller 105 and the follower roller 106 in a forward direction and in a reverse direction by a drive motor. The drive roller 105 is rotated in a counterclockwise direction until a timer 19 detects the passage of a predetermined time, and is rotated in a clockwise direction after a detection as mentioned hereinafter.

Therefore, a paper sheet is easily conveyed to an area facing the separation belt 102, and paper sheets are reliably separated from each other as the paper sheets are separated after they are conveyed to that area.

Roller electrodes 3 and 103 are settled at positions where the former contacts an outer surface of the belt 2 and the latter contacts an outer surface of the belt 102, respectively. Each electrode 3, 103 is connected to an alternating current power source 4 or 104. The roller electrode 3 is set up at a position facing forward the drive roller 5 so that the electrode 3 is not affected by a motion of the feed belt 2 to approach or move away from the stack 1.

The stack 1 of sheets is raised up by a bottom plate 7 that is moved up by rotation of a rotary member 8 driven by a motor not shown. Ascent of the stack 1 is stopped when the uppermost paper sheet 1*a* reaches a position at which the sheet 1*a* can be fed, is detected by a detecting-device not shown. The amount of the ascent is controlled in accordance with remaining paper sheets in the cassette 11.

Guide plates 10 for guiding a traveling of a sheet and a pair of conveyance rollers 9 are provided at the lower reaches of a sheet path from the feed belt 2.

Power sources 4 and 104 are explained in detail in the following.

Figure 2:
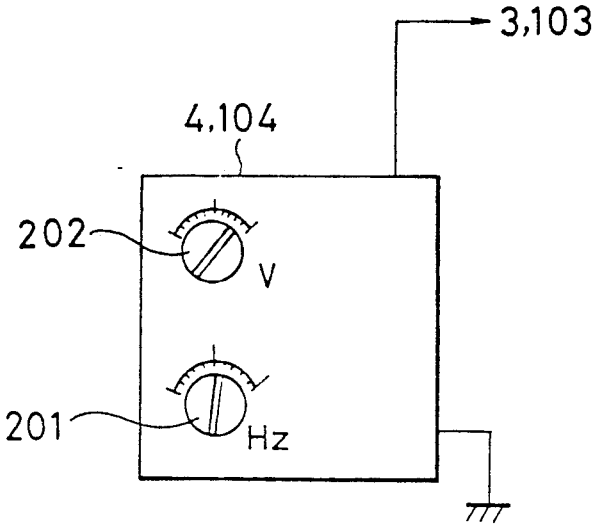
FIG. 2 is a front view of a power source shown in FIG. 1.
Figure 14:
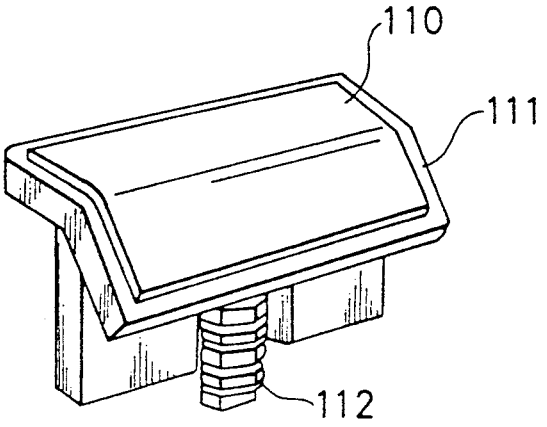
Fig. 14 PRIOR ART
FIG. 14 is a perspective view of a separation unit in FIG. 13.

The power sources 4 and 104 generate an alternating voltage periodically repeating generation of a high voltage and a low voltage consisting of a sine wave, a rectangular wave or the like, and have knobs 202 and 201 to adjust an amplitude and a frequency of the alternating voltage as shown in FIG. 2.

Therefore, the characteristics of the voltage can be adjusted appropriately so that a stable and reliable apparatus for feeding sheets separately can be realized.

A voltage is applied in a form of a sine wave, the amplitude thereof being about ±2kV, and the frequency thereof is set so that a pitch of a charged pattern generated on the belt 2 or 102 becomes about 5 mm in relation to the frequency and a revolution speed of the belt 2 or 102 in this embodiment. These values can be adjusted by the knobs 201 and 202 so that an adequate attractive force is caused in correspondence with a condition of the belt 2 or 102 and the surrounding environment.

A mode of operation of this embodiment is explained in the following.

The stack 1 of sheets is raised up by the bottom plate 7 and the rotary member 8 to a position at which the uppermost paper sheet 1*a* can be fed by the belt 2.

The feed belt 2 starts to rotate in a direction shown by an arrow in FIG. 1 in accordance with a rotation of a drive roller 5, and an alternating charged pattern is generated on a surface of the feed belt 2 by application of an alternating voltage onto the feed belt from a power source 4 through an electrode member 3.

The belt 2 having the alternating charged pattern is brought into contact with the uppermost paper sheet 1*a* of the stack 1 of sheets by a pivotal motion of the drive roller 5.

A paper sheet 1*a* is attracted to be fed by a Maxwell's stress effect caused by the charged pattern on a surface of the feed belt 2. The attractive force owing to the charged pattern acts only upon the uppermost paper sheet 1*a* and does not act upon the lower paper sheet under the paper sheet 1*a*. The feed belt 2 presses on the stack 1 of sheets with a low force (from zero to tens grams of force) so that a friction force between the uppermost paper sheet 1*a* and the facing paper sheet 1*b* is not caused.

The separation belt 102 also starts to rotate in accordance with a rotation of the drive roller 105, and an alternating voltage is applied onto the belt 102 from a power source 104 through an electrode member 103 so that an alternating charged pattern is generated on a surface of the separation belt 102.

The charged pattern is a stripe pattern having a 5 mm pitch generated in accordance with a frequency of an alternating voltage from the power source 4 or 104 and a rotational speed of the belt 2 or 102.

The separation belt is driven in a counterclockwise direction by the drive roller 105 at the beginning of the feed cycle to feed a paper sheet 1*a* so that the paper sheet 1*a* is conveyed between the belts 2 and 102.

A front edge of the paper sheet 1*a* reaches the inner part of a clearance between the belts 2 and 102 when a predetermined time has passed from a time at which the paper sheet 1*a* is picked up by the belt 2. At this time, the drive roller 5 is controlled to be driven in the reverse direction so that the separation belt 102 is rotated in a direction for the paper sheet 1*a* to be returned. However, when an attractive force of the separation belt 102 is set to be weaker than that of the feed belt 2, the paper sheet 1*a* can be conveyed toward guide plates 10 while it is attracted by the feed belt 2.

On the contrary, it often occurs that the uppermost paper sheet 1*a* and the facing paper sheet 1*b* are fed together owing to a tight contact of sheets or burrs on a sheet caused in cutting, when the uppermost paper sheet 1*a* is picked up from the stack 1 by the feed belt 2. In this case, the facing sheet 1*b* is attracted by the separation belt 102 by the Maxwell's stress effect so that it is separated from the paper sheet 1*a* when the sheets 1*a* and 1*b* are conveyed to a position in which the feed belt 2 and the separation-belt 102 face each-other. The paper sheet 1*b* is then returned to a cassette 11 b the reverse rotation of the separation belt 102. When more than three paper sheets are fed together, each sheet is returned in succession from the bottom by an action of the separation belt 102 so that only the paper sheet 1*a* is conveyed toward the guide plates 10 while being attracted to the feed belt 2.

The paper sheet 1*a* is separated from a surface of the feed belt 2 due to a curvature of the drive roller 5 and the stiffness of the paper sheet 1*a* to be conveyed to a sheet path between the guide plates 10, and then, further conveyed toward the lower reaches of the sheet path by a pair of conveyance rollers 9.

The feed belt 2 is kept apart from the stack 1 of sheets before a rear edge of the paper sheet 1*a* reaches a position facing the follower roller 6 so that the next paper sheet is not attracted by the feed belt 2.

Although a belt is used as a separation member in this embodiment, a rotary member such as a roller on which a charged pattern is applied can also be used.

Figure 3:
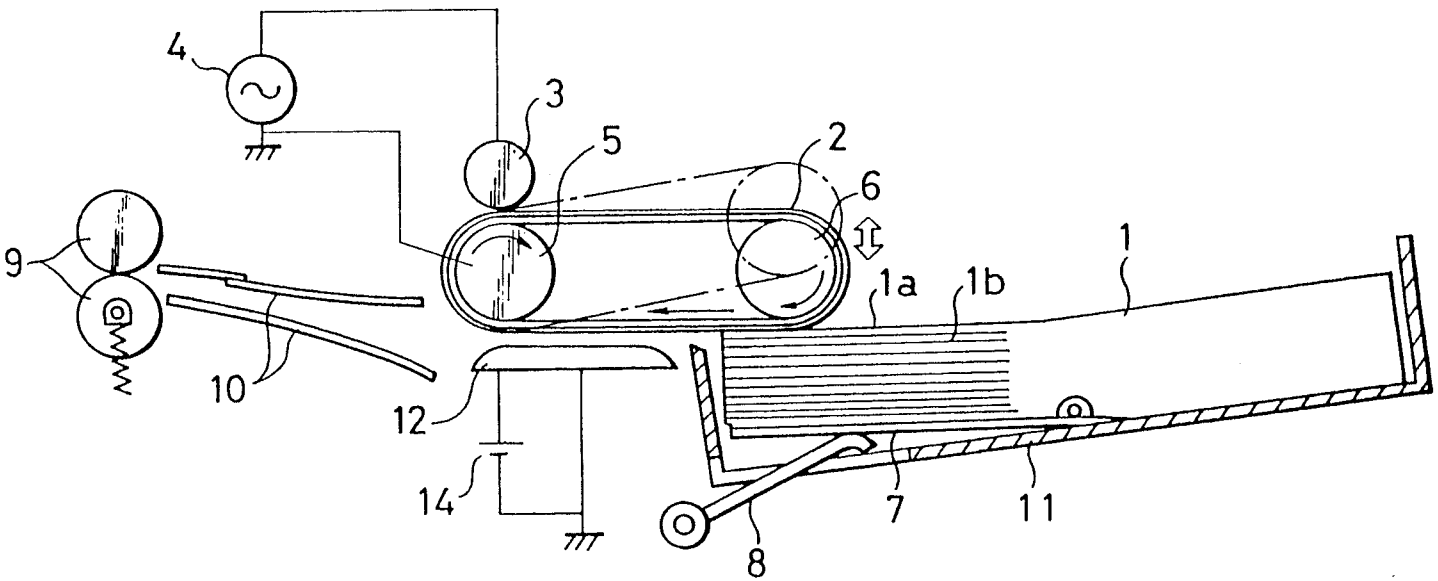
FIG. 3 is a sectional view of the second embodiment of an apparatus for feeding a sheet separately according to the present invention.

The second embodiment shown in FIG. 3. in which embodiment a fixed member is used as a separation member and a charged pattern is generated by a device different from the alternating current power source, is explained in the following.

A fixed separation member 12 is provided at a position facing the feed belt 2 having a small distance from the feed belt 2, instead of the movable separation belt 102. The fixed separation member 12 is constructed so that electrodes 12*c* and 12*d* are arranged alternately, like the teeth of a comb, in a base member 12*a* of an isolator with a small distance between them, and are covered by a dielectric medium 12*b*.

The electrodes 12*c* and 12*d* are respectively connected to each pole of a direct current power source 14. The remaining construction of this embodiment is similar to that of the first embodiment.

Figure 4:
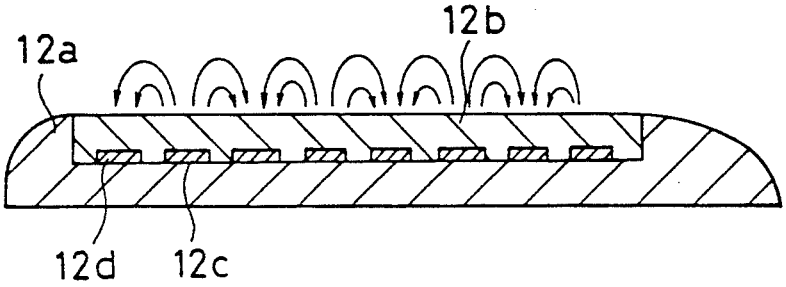
FIG. 4 is a sectional view of a separation unit shown in FIG. 3 and an electric field around the separation unit.
Figure 5:
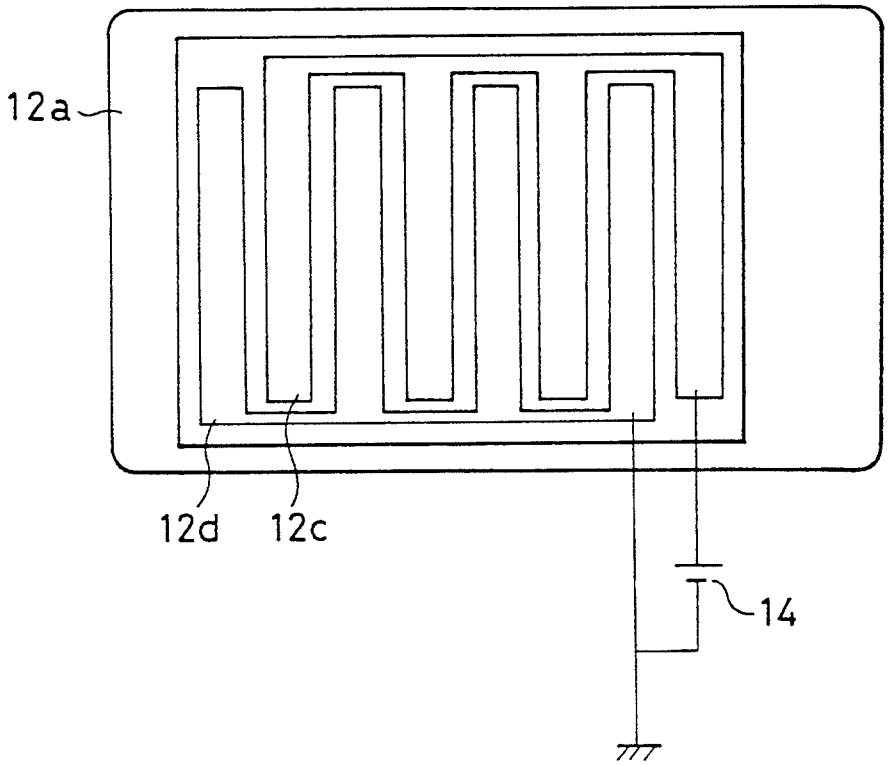
FIG. 5 is a plan view of the separation unit shown in FIG. 3.

The uppermost paper sheet 1*a* attracted by an electrostatic attractive force of the feed belt 2 is conveyed into a clearance between the feed belt 2 and the separation member 12. At this time, an electric power is applied to the separation member 12 from the direct current power source 14 so that a charged pattern is generated on a surface of the dielectric 12*b* as shown in FIG. 4, owing to the pattern of the electrodes 12*c* and 12*d*. An absorptive force is generated on the separation member 12 by the charged pattern so that a paper sheet 1*a* conveyed by the feed belt 2 by attracting the paper sheet 1*a*, tends to be attracted by the separation member 12. However, the paper sheet 1*a* is conveyed while adhered to the feed belt 2 as an attractive force of the feed belt 2 acting on the paper sheet 1*a* is set to be stronger than that of the separation member 12.

A facing paper sheet 1*b* and the uppermost paper sheet 1*a* attracted by the feed belt 2 are occasionally fed together from the stack 1 of sheets owing to burrs of a paper sheet caused in cutting, and the like. The paper sheet 1*b* conveyed into a clearance between the feed belt 2 and the separation member 12, is separated from the paper sheet 1*a* by an attractive force of the separation member 12 so that the paper sheet 1*b* is prevented from being fed and the paper sheet 1*a* is conveyed while adhered to the feed belt 2.

Figure 6:
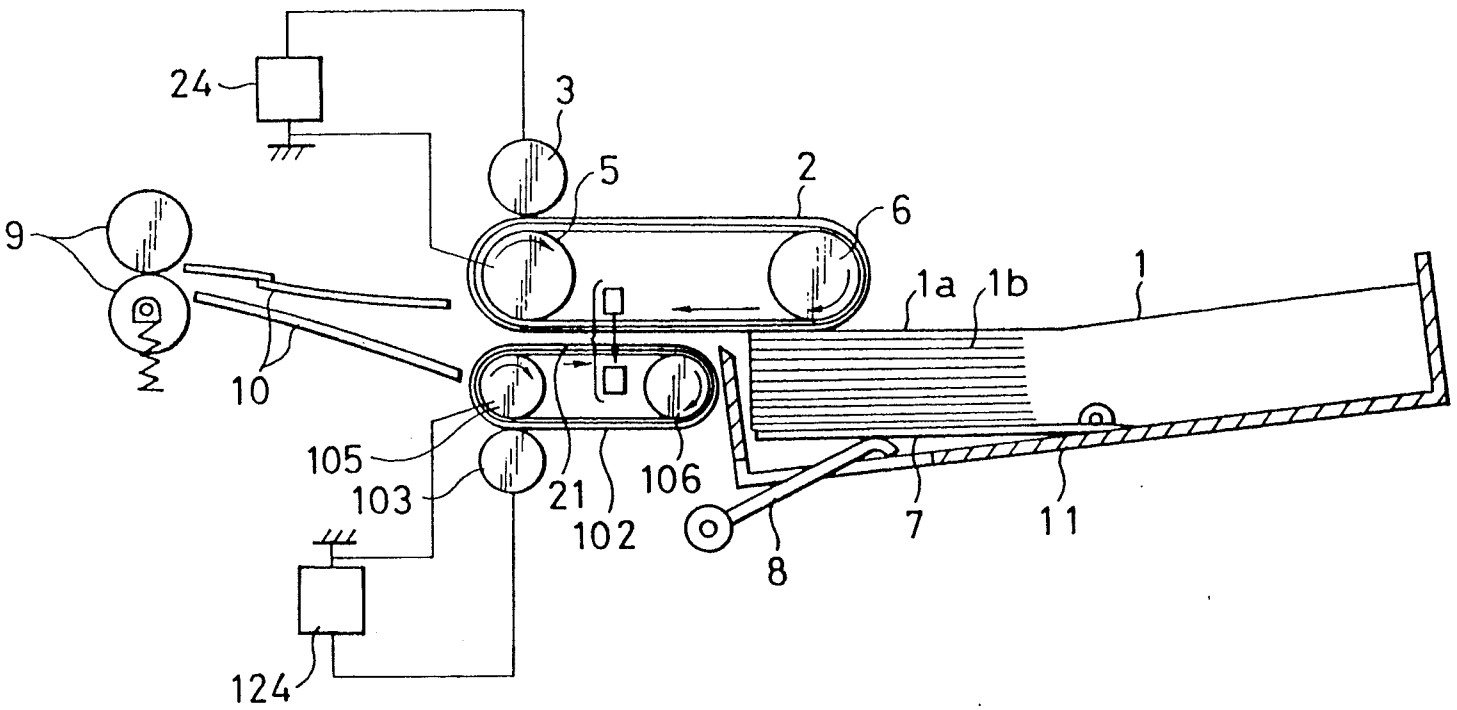
FIG. 6 is a sectional view of the third embodiment of an apparatus for feeding sheets separately according to the present invention.

Next, the third embodiment shown in FIG. 6 is explained in the following. In this embodiment, a part of the structure of the first embodiment is changed. Also in this embodiment, the same members as in the first embodiment have the same reference numbers.

A separation belt 102 is also constructed so as to move upward and downward while maintaining a predetermined clearance between the belt 102 and a feed belt 2 in correspondence to a movement of the feed belt 2 to approach or to move away from a stack 1 of sheets in this embodiment.

Therefore, a stable and reliable separation performance can be realized by the present apparatus as a constant clearance between the feed belt 2 and the separation belt 102 is always maintained.

Figure 8:
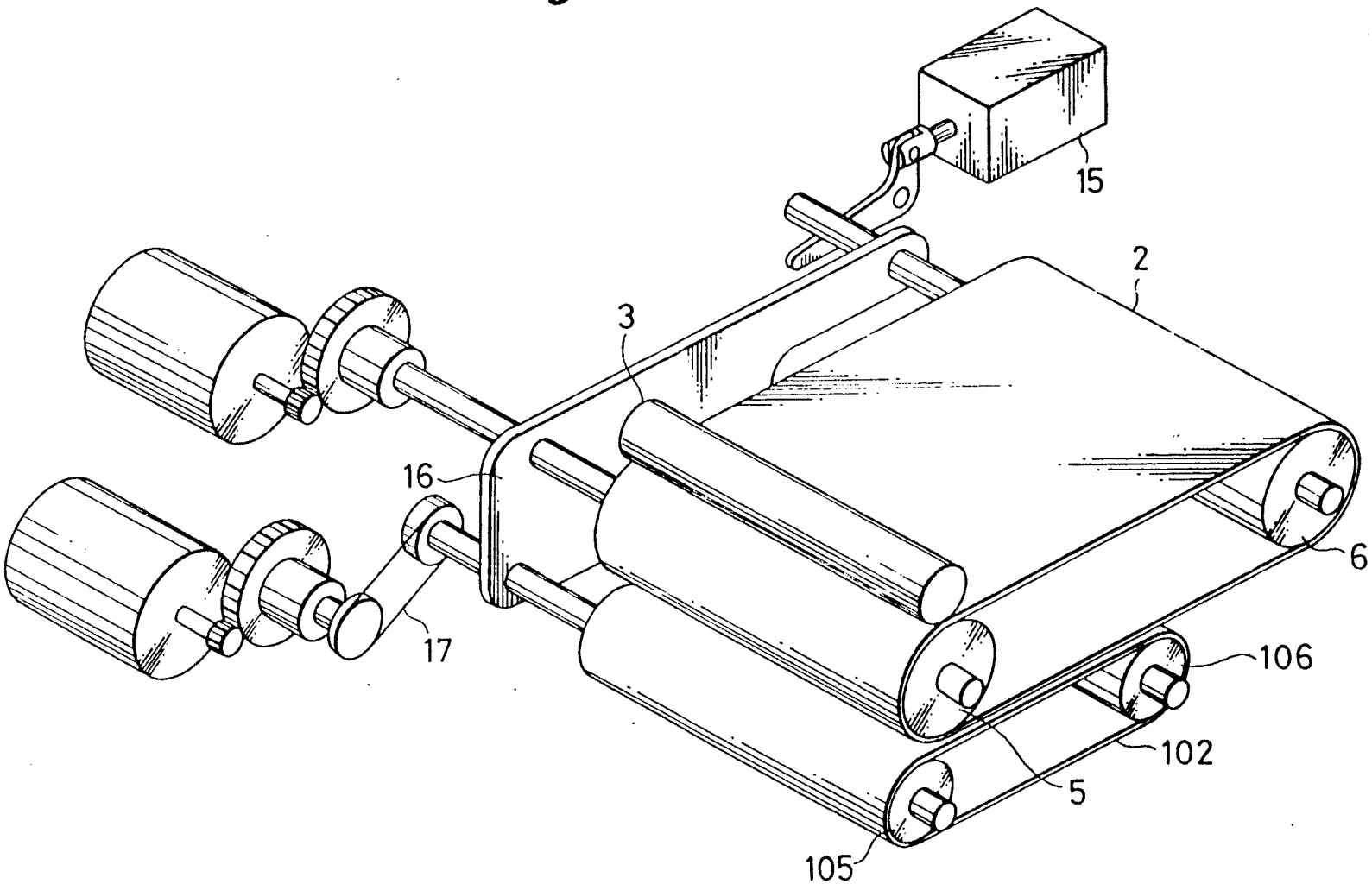
FIG. 8 is a perspective view of a mechanism in FIG. 6 for moving a feed belt and a separation belt integrally.

The tight movement of the belts 2 and 102 in approaching or moving away from the stack 1 of sheets is effected by an ON/OFF control of the same solenoid as the solenoid 15 in the first embodiment. A feed belt unit and a separation belt unit are integrated by a bracket 16 in this embodiment as shown in FIG. 8. The positional discrepancy of a shaft of a drive roller 105 caused during the motion of the feed belt 2 to approach or move away from the stack 1 of sheets is absorbed by an electric belt 17 for transmitting a rotary power from a motor to the shaft of a drive roller 105.

The drive roller 105 is restricted so as to rotate only in a direction in which the motion of the separation belt 102 prevents a conveyance of a paper sheet. A detecting unit 21 comprising a photo sensor for detecting a paper sheet is provided at a position in which a feed belt 2 faces the separation belt 102. Roller electrodes 3 and 103 are connected to power source controllers 24 and 124, respectively.

Figure 9:
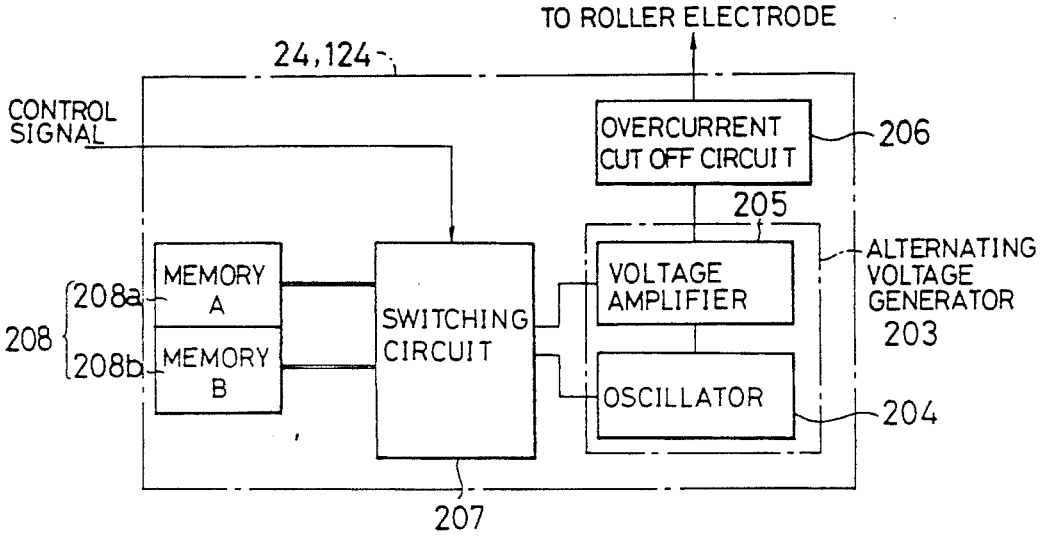
FIG. 9 is a block diagram showing the power source controller in FIG. 6.

The power source controllers 24 and 124 comprise an alternating generator 203 constituted by an oscillator 204 and a voltage amplifier 205, and an overcurrent cutoff circuit 206 as shown in FIG. 9. The oscillator 204 and the voltage amplifier 205 are connected to a memory 208 to store amplitude and frequency settings for a power source through a switching circuit 207 for switching amplitude and frequency settings.

A discharge of a charged dielectric belt is effected by applying an inversely alternating voltage having an amplitude which is the lowest voltage that enables the charging of a dielectric belt, to the charged dielectric belt. An absorptive force of the charged dielectric belt can be reduced owing to a fine pitch of a charged pattern on the belt caused when an alternating voltage having the same amplitude as that of a voltage already used in charging the belt, and a higher frequency is applied.

A most appropriate amplitude and frequency setting for a power source that enables attracting a paper sheet, and a most appropriate amplitude and frequency setting for the power source for discharging, are stored in a memory A 208*a* and a memory B 208*b*, respectively, in this embodiment. The above-mentioned amplitude and frequency for charging or discharging are input to the voltage amplifier 205 and the oscillator 204 in accordance with a control signal input into the switching circuit 207 to switch an amplitude and frequency setting so that the roller electrodes 3 and 103 can be used as chargers and as dischargers. Therefore, the low cost apparatus is realized.

The overcurrent cutoff circuit 206 detects an overcurrent to stop the application of power temporarily when for example a human body touches the roller electrodes 3, 103 or when an electrode is short-circuited by an inner layer of the belt, and so on.

Therefore, the circuit is protected from breaking down due to a shot circuit, and a safety for a human being is ensured if a charged member is touched during maintenance work and so on.

The remaining construction of this embodiment is the same as of the first embodiment.

A mode of operation of this embodiment is explained in the following.

The stack 1 of sheets is raised up by the bottom plate 7 and the rotary member 8 to a position at which the uppermost paper sheet 1*a* can be fed by the belt 2.

Figure 7:
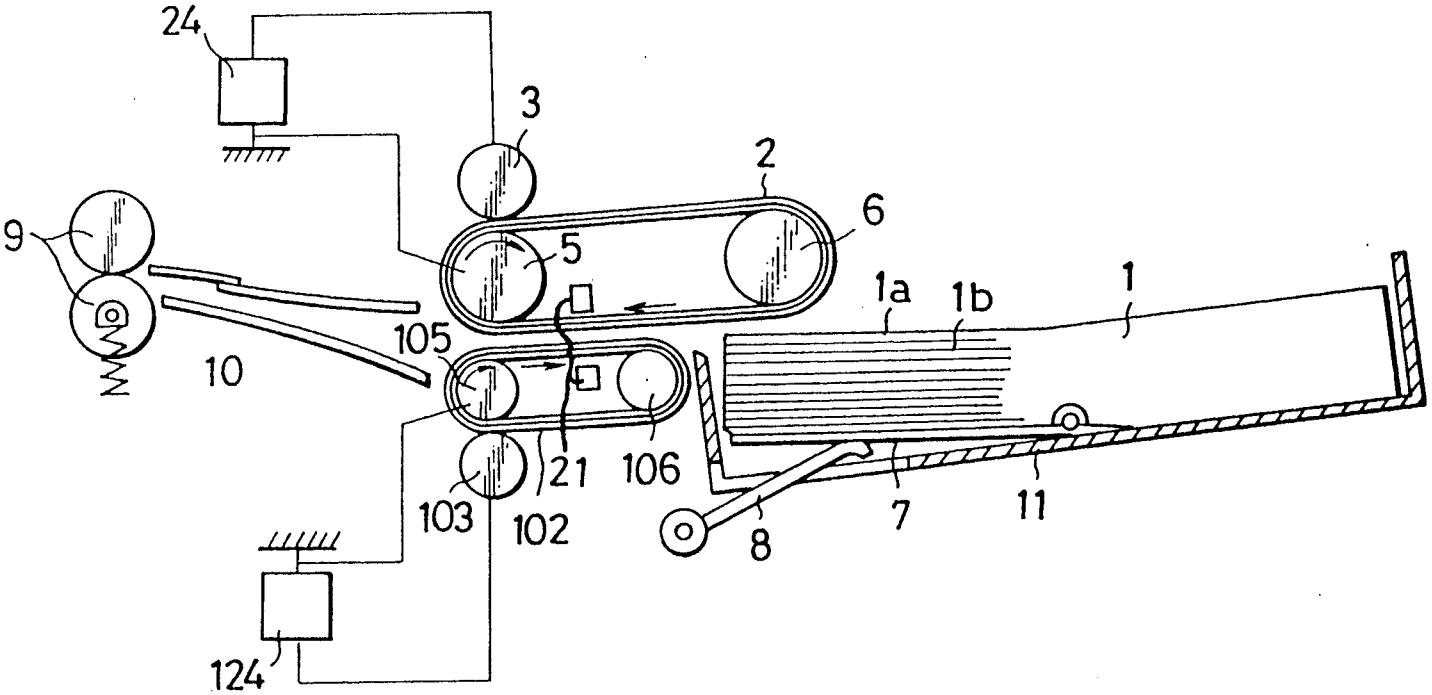
FIG. 7 is a sectional view showing another arrangement of the third embodiment shown in FIG. 6.

The feed belt 2 and the separation belt 102 are positioned initially at a height shown in FIG. 7 at which the feed belt 2 is separated from the uppermost paper sheet of the stack 1.

An alternating voltage is applied to the feed belt 2 from the power source controller 24 through electrode 3, and the belt 2 starts to rotate in a direction shown by an arrow in FIG. 7 due to a rotation of the drive roller 5, so that an alternating charged pattern is generated on a surface of the feed belt 2. On the other hand, the separation belt 102 is simultaneously driven in a direction shown by an arrow in FIG. 7 to return a sheet by the drive roller 105, however, no voltage has yet been applied thereon from the power source controller 124 so that a charged pattern is not generated on a surface of the separation belt 102.

The feed belt 2 generating the charged pattern thereon pivots on the drive roller 5 in a clockwise direction to contact the uppermost paper sheet 1*a* of the stack 1 so that only the paper sheet 1*a* is attracted on to the surface of the belt 2 by the Maxwell's stress effect caused by the charged pattern on the feed belt 2, to be fed as mentioned before.

The paper sheet 1*a* is detected by a detecting unit 21 when the sheet 1*a* is conveyed into a clearance between the feed belt 2 and the separation belt 102 while attracted onto the feed belt 2, and then, an alternating voltage is applied to the separation belt 102 by the power source controller 124 through the electrode 103 so that an alternating charged pattern is generated on a surface of the separating belt 102.

Therefore, a paper sheet is easily conveyed to an area facing the separation belt 102, and paper sheets are steadily separated from each other as the paper sheets are separated after they are conveyed to that area. Furthermore, the drive mechanism is simple as the separation belt 102 is driven only in the inverse direction to the feed direction.

However, the paper sheet 1*a* is conveyed to a space between guide plates 10 while attracted onto the feed belt 2, as an absorptive force of the separation belt 102 is set to be weaker than that of the feed belt 2.

When the uppermost paper sheet 1*a* and the facing paper sheet 1*b* are fed together, the facing paper sheet 1*b* is attracted onto the separation belt 102 by an attractive force of the charged pattern generated on the separation belt 102 in accordance with a detecting signal from the detecting unit 21, so that the paper sheet 1*b* is separated from the paper sheet 1*a*. The paper sheet 1*b* is returned to the cassette 11 as the separation belt 102 is driven in the reverse direction to the feed direction. When three or more paper sheets are picked up at once, each sheet is returned by the separation belt 102 successively so that only the paper sheet 1*a* is conveyed to the space between guide plates 10 while being attracted onto the feed belt 2.

The feed belt 2 leaves the stack 1 of sheets after picking up the paper sheet 1*a*. At this time, the separation belt 102 is moved to maintain a constant clearance between the belt 102 and the feed belt 2 so that the separation of paper sheets is effected reliably when two or more paper sheets are conveyed to clearance between the belts 2 and 102. Namely, only the paper sheet 1*a* is conveyed to a space between the guide plates 10 while attracted onto the feed belt 2.

The attracted paper sheet 1*a* is separated from a surface of the feed belt 2 by a curvature of the drive roller 5 so that the paper sheet 1*a* is conveyed to a sheet path between guide plates 10, and then an end thereof is nipped by a pair of conveyance rollers 9 provided at the lower reaches of the sheet path. A charged region of the feed belt 2 is controlled by the power source controller 24 so that an absorptive force is removed from the feed belt 2 at a position in which a front end of a paper sheet makes contact with the pair of the conveyance roller 9. Furthermore, the separation belt 102 is controlled by the power source controller 124 so that an attractive force is removed from the separation belt 102 when the attractive force is removed from a region of the feed belt 2 facing the separation belt 102.

Therefore, the paper sheet 1*a* is protected from being attracted onto the separation belt 102 so that it cannot be fed when an attractive force of the feed belt 2 is cut, and so a conveyance load on the air of the conveyance rollers 9 can be reduced.

The paper sheet 1*a* is conveyed only by a conveyance force of the pair of conveyance rollers 9 without an effect of the belts 2 and 102, after the paper sheet 1*a* is nipped by the pair of conveyance rollers.

The paper sheet 1*a* is prevented from being attracted onto the separation belt so as not to be fed as an attractive force of the separation belt 102 is made weaken than that of the feed belt 2 in the first and the third embodiments.

The following can be adopted for the method in which an absorptive force of the separation belt 102 is weaker than that of the feed belt 2.

An attractive force of the separation belt 102 can be weakened by shortening a length of the separation belt 102 in a sheet path direction or by reducing a width so as to be shorter or narrower than that of a feed belt 2, as the attractive force is proportional to the area of attraction.

An attractive force of the separation belt 102 can be weakened by reducing the amplitude of an alternating voltage applied to the separation belt 102 so as to be smaller than that applied to the feed belt 2 as the attractive force of a belt depends on an amplitude of a voltage for generating an alternating charged pattern on the belt.

Furthermore, an absorptive force of the separation belt 102 can be weakened by increasing the frequency of an alternating voltage applied to the separation belt 102 so as to be higher than that applied to the feed belt 2, as the attractive force of a belt depends on the pitch of an alternating charged pattern generated on the belt.

Furthermore, an attractive force of the separation belt 102 can be reduced by reducing the rotational speed of the separation belt 102 so as to be lower than that of the feed belt 2.

Figure 10:
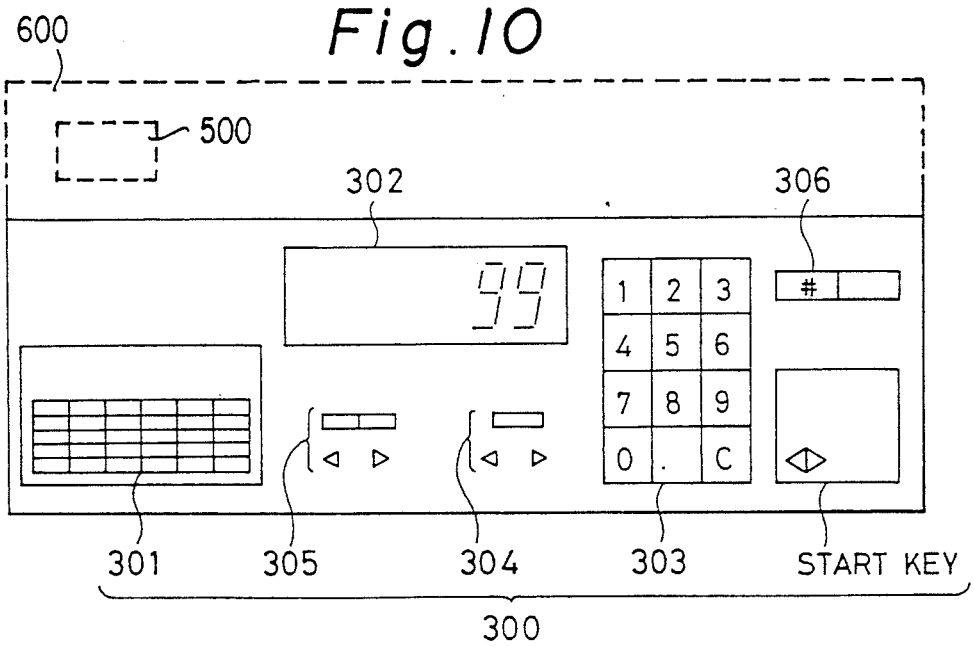
FIG. 10 is a plan view of an operational panel of a copy machine for the apparatus according to the present invention.

The memory 208 for, storing an amplitude and frequency setting for a power source shown in FIG. 9, is replaced by a memory 500 the device illustrated in FIG. 10 and the switching circuit 207 for switching an amplitude or frequency setting is replaced by a part of a program to control the device itself so that another embodiment of the apparatus for feeding sheets separately is constructed and mounted on an image-forming device 600 such as the copy machine. An amplitude and frequency setting for a power source can be handled as software stored as numerical values so that the system of the image-forming device can be easily constructed.

Keys 301 and so on disposed on an operational panel 300 shown in FIG. 10 can be used as an input unit for inputting an amplitude and a frequency to the memory, and a display 302 of the device itself can be used as a confirmation unit for confirming the input contents.

Therefore, the characteristics of the voltage can be set up quickly and arbitrarily and the set up values can be checked so that a stable apparatus for feeding sheets separately can be realized.

Figure 11:
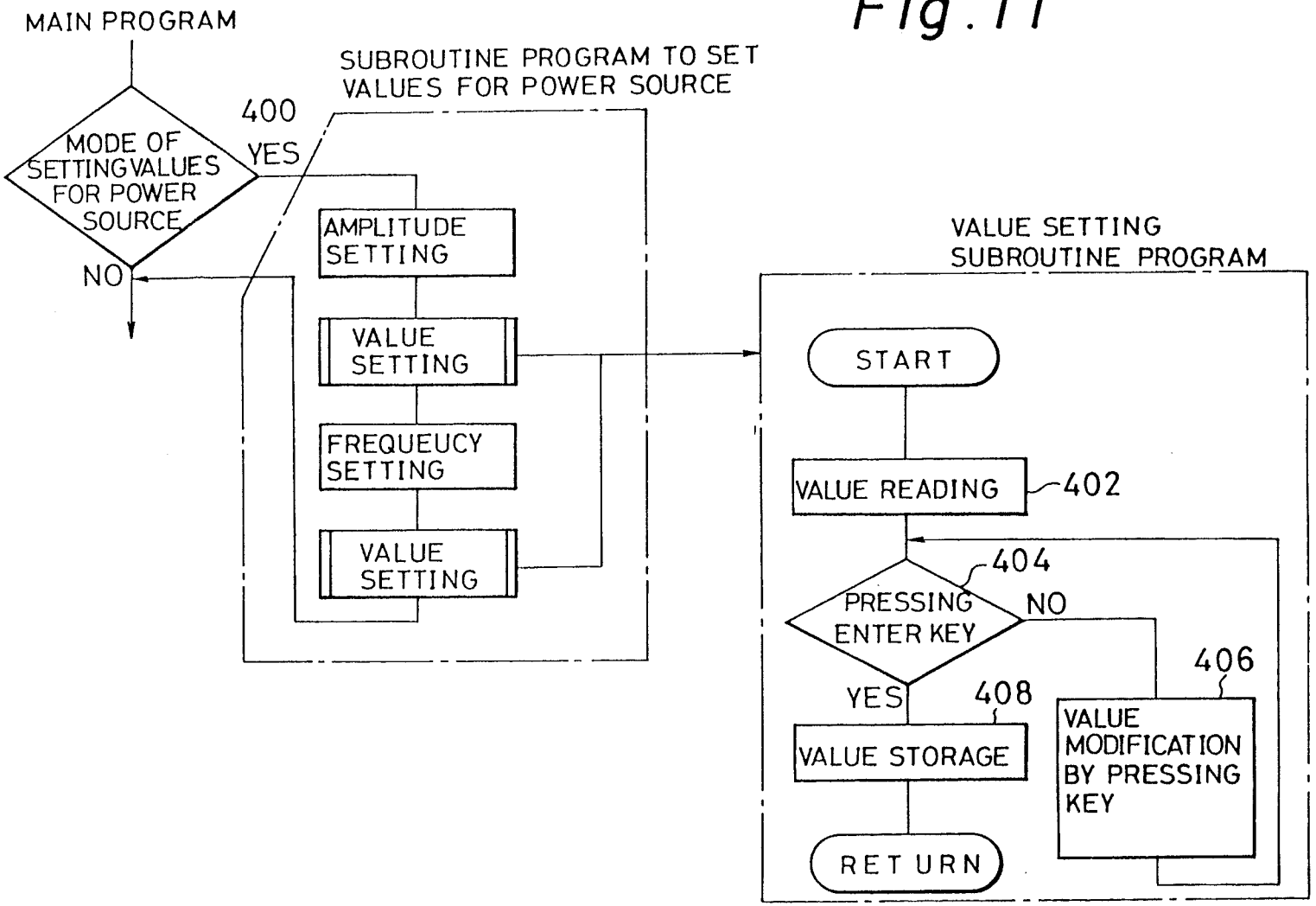
FIG. 11 is a flow chart showing a process for setting an amplitude and a frequency of the power source.
Figure 12:
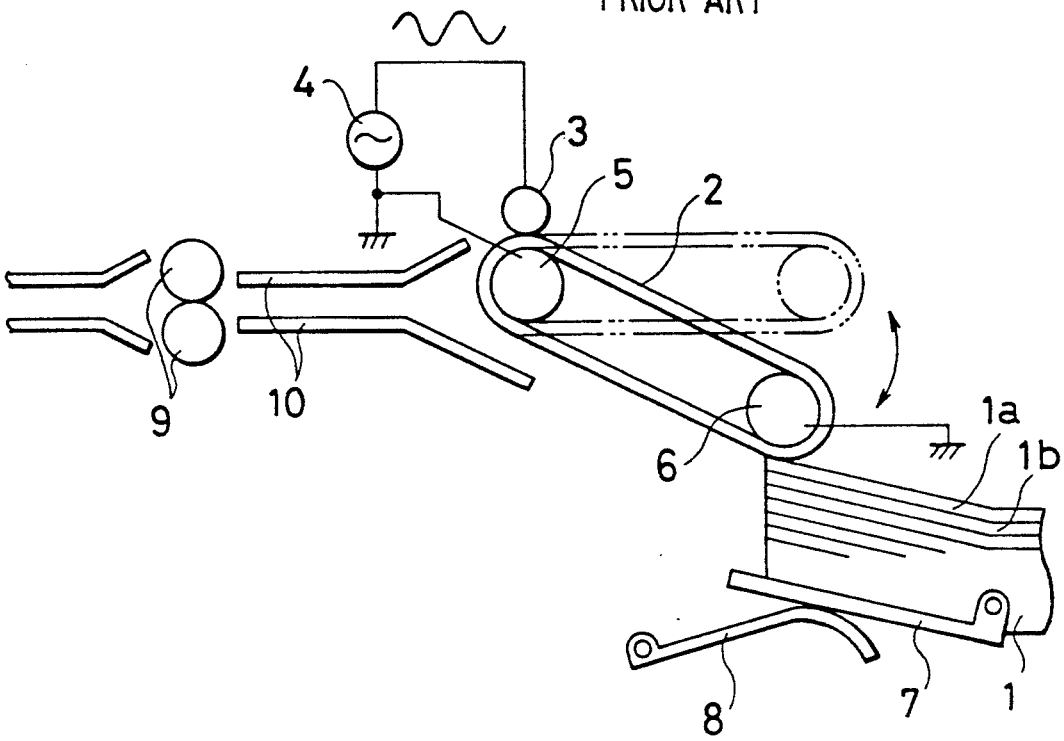
Fig. 12 PRIOR ART
FIG. 12 is a sectional view of an embodiment of an apparatus for feeding sheets separately according to the related art.
Figure 13:
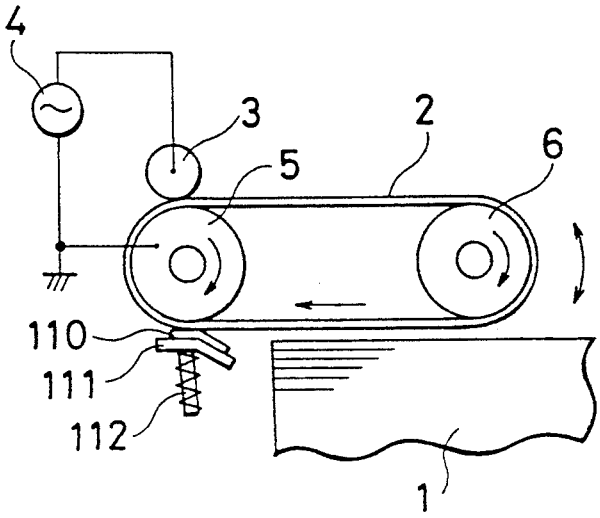
Fig. 13 PRIOR ART
FIG. 13 is a sectional view of an another embodiment of an apparatus for feeding sheets separately according to the related art.

Next, a process for setting an amplitude and a frequency for a power source is explained referring to FIGS. 10 and 11. Initially, a mode of setting values for a power source for an apparatus for feeding sheets separately, is indicated by pressing a predetermined key of the mode keys 301 on the operational panel 300, so that a program of the device itself shifts to a subroutine program for setting values for a power source of an apparatus for feeding sheets separately at step 400.

In the subroutine program, a value setting subroutine program is called when an amplitude or a frequency is determined. In the value setting subroutine program, an amplitude of a voltage to be set and stored in the memory is read at step 402. The amplitude is displayed on the display 302 on which the number of copies to be made, a magnification of a copy, and so on, are usually displayed. An operator checks the value on the display. When the amplitude is to be modified, as a result of the check, a ten-key keypad 303 or the keys 304, 305 for increasing or reducing a shade depth, or for scaling a copy up or down, are pressed so that the amplitude is modified to be a desired value.

After this, an enter key 306 is pressed down so that the above-mentioned value is fixed. This pressing of the enter key 306 is pressed down so that the above-mentioned value is fixed. This pressing of the enter key 306 is detected at step 404, and at the next step 408, the fixed value is stored in a power source region in the memory.

For the frequency, a similar setting procedure is effected so that the frequency is determined, and then the subroutine program to set values for a power source of an apparatus for feeding sheets separately is closed.

When an amplitude or a frequency read from the memory at step 402 does not need to be modified, the enter key 306 is pressed down so that the value is fixed and stored in the power source region in the memory at step 408.

Many widely different embodiments of the present invention may be constructed without departing from the spirit and scope of the present invention. It should be understood that the present invention is not limited to the specific embodiments described in the specification, except as defined in the appended claims.

What is claimed is:

1. An apparatus for feeding sheets separately comprising:

a feeding means disposed over a stack of sheets for causing a conveyance force upon the uppermost sheet of said stack thereby to feed said uppermost sheet from said stack, said conveyance force being directed in a sheet path direction, said feeding means having an alternating charged pattern on a surface thereof; and a separating means disposed opposite to said feeding means so as to form a sheet path in association with said feeding means for causing a preventive force onto an under face of said fed sheet thereby to prevent said sheet from being fed, said preventive force being set to be less than said conveyance force and greater than a friction force between sheets, said separating means having another alternating charged pattern on a surface thereof;

said feeding means and said separating means being spaced from each other at a predetermined distance, said feeding means being adapted to move so as to make contact with or to be spaced from said uppermost sheet, and said separating means being adapted to move so as to be kept spaced from said feeding means at said predetermined distance when said feeding means moves.

2. An apparatus according to claim 1, wherein said sheet comprises a paper sheet.

3. An apparatus according to claim 1, whereins aid separating means comprises an endless belt member rotating in a clockwise direction or in a counter-clockwise direction, said feeding means and said belt member are provided with a timer which counts a predetermined time from a start of rotating of said belt member, said belt member being adapted to rotate in a counter-clockwise direction when said timer counts said predetermined time.

4. A apparatus according to claim 1, wherein said separating means is adapted to be kept in a non-operating state until said sheet reaches a position at which said feeding means and said separating means face each other and to be kept in an operating state after said sheet reaches said position.

5. An apparatus according to claim 1, wherein said separating means is adapted to be kept in a non-operating state when said feeding means is kept in a non-operating state.

6. An apparatus according to claim 1, wherein each of said feeding means and said separating means comprises an electrode member, and a power source controller for generating an alternating voltage and for supplying said alternating voltage to said electrode member.

7. An apparatus according to Claim 6, wberein said power source controller further comprises an switching means for switching at least one of an amplitude and a frequency setting of said supplied alternating voltage.

8. An apparatus according to claim 6, wherein said power source controller further comprises a preventing means for detecting an overcurrent to said electrode member and for stopping said alternating voltage when said overcurrent is detected.

9. An apparatus according to claim 6, wherein said power source controller further comprises a memory means for storing set values of said amplitude and said frequency.

10. An apparatus according to claim 9, further comprising selecting means for selecting a set value from respective set values of said memory means thereby to send said selected set value to a generator.

11. An apparatus according to claim 9, further comprising input means for entering a set value in said memory means and a display means for displaying said entered set value.

12. An apparatus according to claim 9, wherein said power source controller further comprising input means for entering a set value in said memory means and a display means for displaying said entered set value, and wherein said memory means, said input means, and said display means respectively are incorporated into a memory of, an operational panel of, and a display of an image-forming device on which said apparatus is mounted.

* * * * *